US011339648B2

(12) United States Patent
Joshi et al.

(10) Patent No.: US 11,339,648 B2
(45) Date of Patent: May 24, 2022

(54) SYSTEMS AND METHODS FOR WIRELESS COMMUNICATION IN A WELL

(71) Applicant: Baker Hughes Oilfield Operations LLC, Houston, TX (US)

(72) Inventors: Mahendra L. Joshi, Katy, TX (US); Yi Liao, Edmond, OK (US); Thomas McClain Scott, Cypress, TX (US); Alexey Tyshko, Oklahoma City, OK (US); Virginia Howe, Oklahoma City, OK (US); Brian Reeves, Edmond, OK (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 42 days.

(21) Appl. No.: 16/870,651

(22) Filed: May 8, 2020

(65) Prior Publication Data

US 2020/0362691 A1 Nov. 19, 2020

Related U.S. Application Data

(60) Provisional application No. 62/848,364, filed on May 15, 2019.

(51) Int. Cl.
*E21B 47/13* (2012.01)
*E21B 47/07* (2012.01)
(Continued)

(52) U.S. Cl.
CPC ..... *E21B 47/13* (2020.05); *E21B 17/003* (2013.01); *E21B 17/028* (2013.01);
(Continued)

(58) Field of Classification Search
CPC ..... E21B 47/13; E21B 47/26; E21B 17/003; E21B 17/028; E21B 43/126; E21B 47/00;
(Continued)

(56) References Cited

U.S. PATENT DOCUMENTS 4,057,781 A * 11/1977 Scherbatskoy ..... E21B 47/13 340/854.4
4,302,757 A * 11/1981 Still ..... E21B 47/13 340/854.4

(Continued)

*Primary Examiner* — Brad Harcourt
(74) *Attorney, Agent, or Firm* — Sprinkle IP Law Group

(57) ABSTRACT

Systems and methods for communicating between surface equipment and a downhole tool installed in a well. First and second toroidal transformers are positioned around an inner one of a pair of coaxial structural members of a well completion (e.g., a pump rod and tubular, or a tubular and a well casing) which are electrically coupled to form an electrical circuit. A transmitter generates a data signal which is applied to the first toroidal transformer, causing a corresponding electrical current to be induced in the circuit, which then induces the data signal on the second toroidal transformer. A receiver coupled to the second toroidal transformer receives the data signal induced on the second toroidal transformer. The transmitter and receiver may be components of transceivers that may communicate bidirectionally. Additional toroidal coils and transceiver may be provided to communicate with equipment at additional locations in the well.

16 Claims, 12 Drawing Sheets

(51) Int. Cl.

| | |
|---|---|
| ***E21B 41/00*** | (2006.01) |
| ***E21B 47/12*** | (2012.01) |
| ***E21B 47/26*** | (2012.01) |
| ***E21B 17/00*** | (2006.01) |
| ***E21B 17/02*** | (2006.01) |
| ***E21B 43/12*** | (2006.01) |
| ***E21B 47/00*** | (2012.01) |

(52) U.S. Cl.
CPC ..... *E21B 41/0085* (2013.01); *E21B 43/126* (2013.01); *E21B 47/00* (2013.01); *E21B 47/07* (2020.05); *E21B 47/12* (2013.01); *E21B 47/138* (2020.05); *E21B 47/26* (2020.05)

(58) Field of Classification Search
CPC ..... E21B 47/12; E21B 47/07; E21B 41/0085; E21B 47/138
See application file for complete search history.

(56) References Cited

U.S. PATENT DOCUMENTS

| | | | | |
|---|---|---|---|---|
| 2009/0166023 | A1* | 7/2009 | Svenning ..... | E21B 17/028 166/65.1 |
| 2017/0356274 | A1* | 12/2017 | Thompson ..... | E21B 47/12 |
| 2019/0292905 | A1* | 9/2019 | Ross ..... | E21B 47/10 |

* cited by examiner

SYSTEMS AND METHODS FOR WIRELESS COMMUNICATION IN A WELL

RELATED APPLICATIONS

This application claims priority under 35 U.S.C. § 119(e) to U.S. Provisional Application No. 62/848,364, entitled "Systems and Methods for Wireless Communication in a Well", filed May 15, 2019, which is fully incorporated herein by reference for all purposes.

BACKGROUND

Field of the Invention

The invention relates generally to the operation of downhole equipment, and more particularly to systems and methods for communication between equipment such as surface equipment and downhole equipment installed in a well using conductive rods, tubulars and/or casings to form an electrical circuit.

Related Art

Gas wells often require the use of an artificial lift system to remove water or other well fluids from the well when the fluid level rises to a level that impedes gas production. Most production systems in coal seam gas (CSG) wells use progressive cavity pumps (PCPs) to remove water from CSG wells and maintain a wellbore water level that is below a desired maximum level. Some CSG wells use rod lift systems (RLSs) as an alternative to PCPs to remove water from the wells.

CSG well operation is intermittent in nature due to changes in the water level in the well. In other words, gas is produced for some interval of time, then water is produced for an interval, then gas is produced again, and so on, alternating between a gas production phase and a water production phase. This is because, during the gas production phase, the gas flows in the annular space between casing and PCP pump assembly, but water in this annular space may rise to a level that impedes the gas flow.

As the gas is being produced, the pump system (PCP or RLS) is normally turned off, and the water level in the well may rise. When the water level is higher than desired, the pump is turned on to remove water (typically with coal fines) from the well and thereby reduce the water level in the well. The PCP is commonly turned on when water in the annular space in the well reaches a certain hydrostatic head or pressure limit. Conventionally, this hydrostatic head or pressure is measured by a downhole gauge which is coupled by wires to the surface so that it can receive power and transmit (or receive) data. A surface controller for the PCP system will operate the system until the hydrostatic head of the water in the well is reduced to a desired value. At this point, the PCP system is shut off, and gas production resumes, with gas flowing through the annular space.

The most common failure mode of PCP systems in CSG wells is stator burn-up which is caused by pumping off the water so that the pump runs dry. This may occur as the rate at which water enters the well declines after a few months of production. The pumping off of the water may result from a problem such as a damaged electrical cable or poor connectivity between the downhole pressure gauge and the surface controller, which may cause a failure of the downhole pressure gauge to provide an appropriate signal to the surface controller to indicate a reduced water level. Thus, the PCP system would continue to operate, even during the gas production phase. As the water is pumped off, the gas would enter the PCP system, undergo compression due to the positive displacement feature of the PCP system, and overheat the stator. The overheating may then lead to thermal degradation of the stator material (rubber), compromising the pump integrity.

The failure of the pump system introduces additional equipment and workover costs, which may amount to hundreds of thousands of dollars. The costs may be incurred because, for example, the well may have to be killed in order to re-complete the well if the wired gauge line cannot be snubbed out due to well control. The well may also potentially lose months of production, as the PCP would need to be brought online to dewater the well again in order for gas to flow in the well.

It is therefore very important to communicate information regarding downhole conditions (e.g., water level) to the control equipment at the surface of the well (e.g., controlling the operation of a pump to avoid pump-off). As noted above, problems with conventional communication systems between the downhole equipment and the surface equipment may experience poor or failed connectivity as a result of damaged electrical cables, which may lead to damage or failure of the downhole equipment (e.g., stator burn-up), which may in turn result in lost production, as well as increased costs associated with repairs and re-starting production. It would therefore be desirable to provide systems and methods which reduce or eliminate the problems associated with conventional wired communication systems.

SUMMARY

Embodiments disclosed herein provide systems and methods for providing wireless communications between a downhole gauge or other tool that is positioned in a well bore and a unit at the surface of the well. Embodiments use toroidal coils that are positioned around a component such as a pump rod that extends axially in the well, where a data signal applied to one toroidal coil induces currents in the axially extending component, and these currents induce a voltage in another toroidal coil which can be sensed to receive the data.

One embodiment comprises a system for communicating between surface equipment and a downhole tool installed in a well. The system includes first and second structural members of a well completion which are connected by first and second electrical couplings to form a first electrical circuit. A first toroidal transformer is positioned around the second structural member at an axial location which is between the first and second electrical couplings. A second toroidal transformer is also positioned around the second structural member, but is positioned at a different axial location between the first and second electrical couplings. A transmitter is coupled to the first toroidal transformer and is configured to generate a data signal (which in one embodiment has a frequency of between 30 Hz and 300 Hz), where when the data signal is applied to the first toroidal transformer. This causes a corresponding electrical current to be induced in the first electrical circuit, which then induces the data signal on the second toroidal transformer. A receiver is coupled to the second toroidal transformer in order to receive the data signal induced on the second toroidal transformer. The transmitter and receiver and the corresponding toroidal coils may be arranged to transmit data from the surface equipment to the downhole tool, or from the downhole tool to the surface equipment. The transmitter and receiver may be components of corresponding transceivers, and the system may be capable of transmitting data bidirectionally. The system may also include one or more additional toroidal coils and corresponding transceivers so that data may be communicated to/from multiple different locations in the well.

In one embodiment, the first structural member comprises a conductive casing installed in the well, and wherein the second structural member comprises a conductive tubular installed in the well within the casing. In another embodiment, the first structural member comprises the casing of the well and the second structural member comprises a conductive pump rod coupled between a drive system and a pump installed in the well. In yet another embodiment, the first structural member comprises a conductive tubular installed in the well, and the second structural member comprises the conductive pump rod. In some embodiments, there is an annular space between the first and second structural members, where a first portion of the annular space is filled with a well fluid and a second portion of the annular space is filled with air. In one embodiment, the first portion of the annular space is no more than 60 feet in length and the second portion of the annular space is at least 100 feet in length.

An alternative embodiment comprises a method implemented in a well having first and second structural members of a well completion system electrically coupled to form a first electrical circuit, the well completion system including first and second toroidal transformers positioned at axially different locations around one of the structural members with a transmitter coupled to the first toroidal transformer and a receiver coupled to the second toroidal transformer. The method includes generating a first voltage embodying a data signal at the transmitter and applying the first voltage to the first toroidal transformer. The first toroidal transformer induces a current corresponding to the data signal in the structural members (e.g., a pump rod or tubular) around which it is positioned. This induces in the second toroidal transformer a second voltage embodying the data signal. The second voltage is provided to the receiver and the receiver extracts the data signal from the second voltage.

In one embodiment, the method includes making measurements using equipment positioned downhole in a well, generating the data signal in dependence on the measurements, and providing the data signal to the transmitter. The data corresponding to the measurements may be stored in a data store prior to being transmitted. The measurements may comprise measurements of operating conditions at the location of an electric submersible pump installed in the well. Data may be communicated between the first and second toroidal coils, as well as additional toroidal coils positioned along the length of the structural member.

Numerous other embodiments are also possible.

BRIEF DESCRIPTION OF THE DRAWINGS

The drawings accompanying and forming part of this specification are included to depict certain aspects of the invention. A clearer impression of the invention, and of the components and operation of systems provided with the invention, will become more readily apparent by referring to the exemplary, and therefore non-limiting, embodiments illustrated in the drawings, wherein identical reference numerals designate the same components. Note that the features illustrated in the drawings are not necessarily drawn to scale.

Figure 1:
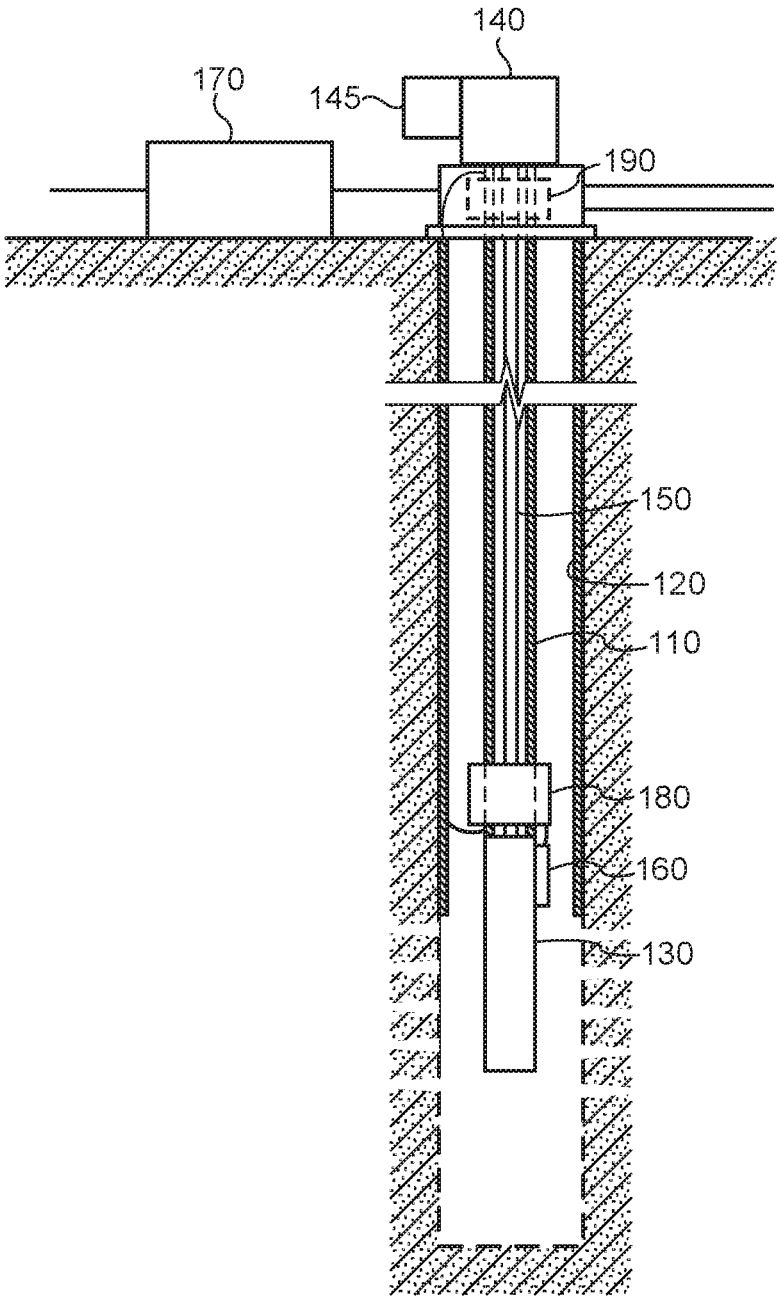
FIG. 1 is a diagram illustrating an exemplary system wireless communication system for a downhole tool in accordance with one some embodiments.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the described embodiments. Further, the drawings may not be to scale, and may exaggerate one or more components in order to facilitate an understanding of the various features described herein.

DESCRIPTION

The invention and the various features and advantageous details thereof are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention in detail. It should be understood, however, that the detailed description and the specific examples, while indicating some embodiments of the invention, are given by way of illustration only and not by way of limitation. Various substitutions, modifications, additions, and/or rearrangements within the spirit and/or scope of the underlying inventive concept will become apparent to those skilled in the art from this disclosure.

The invention and the various features and advantageous details thereof are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention in detail. It should be understood, however, that the detailed description and the specific examples, while indicating some embodiments of the invention, are given by way of illustration only and not by way of limitation. Various substitutions, modifications, additions, and/or rearrangements within the spirit and/or scope of the underlying inventive concept will become apparent to those skilled in the art from this disclosure.

As described herein, various embodiments of the invention comprise systems and methods for providing communications between equipment installed downhole in a well and equipment at the surface of the well. These embodiments may allow for the downhole tools to wirelessly communicate data to (and receive data from) the surface equipment. In one exemplary embodiment, downhole equipment such as a submersible pump is installed in a cased well. The submersible pump is coupled to a tubular through which fluid is pumped to the surface of the well. A wireless communication system uses one toroidal coil to induce currents in the tubular and another toroidal coil to sense the current near the submersible pump. Data is communicated from the first coil, through the tubular, to the second coil.

The wireless communication system uses what may be referred to herein as a toroid coupled line (TCL) to enable data communication between the surface equipment and the downhole equipment. This system uses a first toroidal transformer which is positioned around the tubular at or near the pump, and a second toroidal transformer which is positioned around the tubular at or near the surface equipment. Transceivers are coupled to each of the toroidal transformers. One of the transceivers (e.g., at the pump) generates electrical signals that are applied to the corresponding toroidal transformer, thereby inducing current in the tubular. The tubular is electrically coupled to the casing of the well in order to complete a circuit through which the induced current flows. The current in the tubular in turn induces current in the other transformer, which is detected by the corresponding transceiver. The transceiver interprets the detected current to identify the data embodied in the signal and provides this data as an output to control equipment, a user display, or some other device.

It should be noted that the TCL makes use of one electrically conductive component that is substantially concentrically positioned within another, tubular electrically conductive component. In some embodiments, the inner component is a tubular and the outer component is the well casing. In other embodiments, inner component may be a rod which drives the pump, and the outer component may be the well casing or a tubular.

Referring to FIG. 1, a diagram illustrating an exemplary system in accordance with one embodiment of the present invention is shown. The well depicted in this figure may be representative of a coal seam gas well. Gas enters the well through perforations in the casing and formation and flows upward through the annular space between the casing of the well and production tubing 110 that is installed in the well. Water may also enter the well from the surrounding formation, and when the water levels are too high, the water impedes the flow of gas into the well. The water must therefore be periodically removed from the well to allow gas to be efficiently produced from the well.

As shown in FIG. 1, production tubing 110 is installed in the cased well. A pump (e.g., PCP) 130 is installed downhole in the well to enable the periodic removal of water from the well. A drive 140 for pump 130 is installed at the surface of the well and is coupled to pump 130 by a rod 150. Drive 140 is driven by prime mover 145 to rotate rod 150. Rod 150 in turn rotates a rotor of pump 130 within a stator of pump 130, causing water and suspended coal fines (as well as any other liquids that may have accumulated in the well) to be pumped up through production tubing 110 and out of the well.

A wireless gauge 160 is installed downhole in the well near pump 130. Wireless gauge 160 in this embodiment is configured to monitor the pressure of the water in the well and to communicate this information to a controller 170 at the surface of the well. Surface controller 170 is coupled to drive 140 and prime mover 145 and is configured to cause these units to drive rod 150 and pump 130 as needed to remove water from the well. When the water level in the well is low enough to allow gas to be produced, surface controller 170 controls driver 140 and prime mover 145 to stop, suspending operation of pump 130 so that pump off conditions do not cause overheating of pump 130. ("Water", as used here, should be construed to include brine or other fluids that may be found in the well.)

In this embodiment, wireless gauge 160 has a transceiver that is coupled to a toroidal coil 180 which is mounted around tubing 110. When it is necessary to transmit data from gauge 160 to controller 170, an electrical signal that embodies the data is generated and applied to coil 180, causing current to flow through the coil. The magnetic fields generated by the current flowing through the coil induces a corresponding current in tubing 110. This current flows through tubing 110 and itself induces current in a second toroidal transformer 190 which is positioned at the upper end of the tubing. (It should be noted that tubing 110 is electrically coupled to the well casing 120 just below toroidal transformer 180, and just above toroidal transformer 190, so that tubing 110 and casing 120 form a complete circuit through which current can flow.) the current in toroidal transformer 190 is sensed by a transceiver coupled to surface controller 170, which extracts the data embodied in the current and processes or uses the data to control pump 130. In a similar manner, surface controller 170 can communicate data through toroidal transformer 190, tubing 110 and toroidal transformer 180 to a transceiver which provides this data to pump 130.

Figure 2:
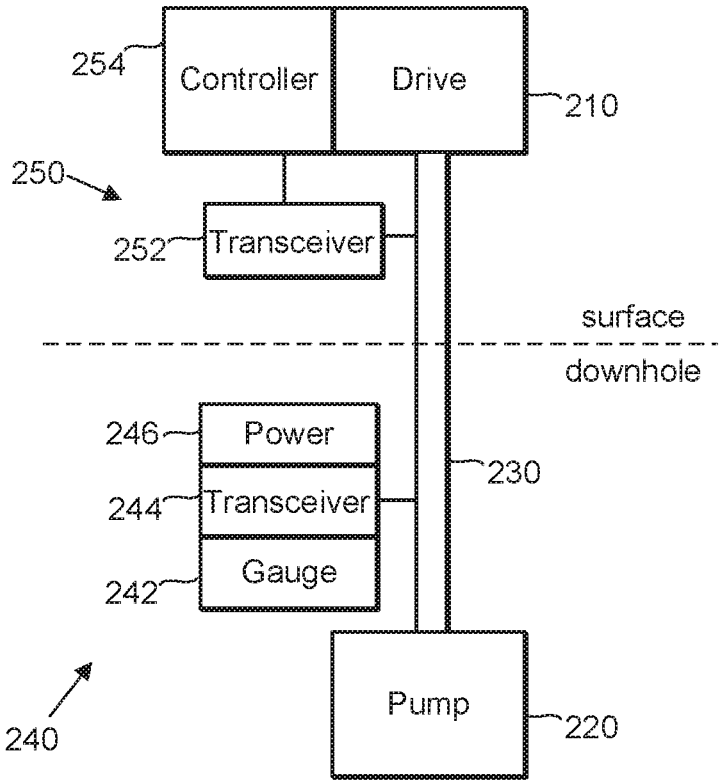
FIG. 2 is a functional block diagram illustrating the general relationship of the components of a wireless communication and power system in accordance with some embodiments.

Referring to FIG. 2, a functional block diagram illustrating the general relationship of the components of a pump system having means for wireless communication and power transmission in one embodiment is shown. As depicted in this figure, a drive system 210 is coupled to a pump system 220 by a rod which extends through production tubing (which may be referred to as a tubular) in a well. The rod and tubular form a pair of coaxially arranged conductors 230 which extend from the surface of the well to the downhole location of the pump. Pump system 220 may, for example, use a PCP-type or RLS-type pump. In the case of a PCP-type pump, the rod connecting the drive system to the pump rotates, thereby rotating a rotor of the PCP-type pump. In the case of an RLS-type pump, the rod moves in a reciprocating motion, thereby causing a mover of the RLS-type pump to move in a reciprocating motion.

It should be noted that, although this exemplary embodiment describes a pump that uses a rod to drive the pump, where the rod serves as one conductor of the pair of coaxial conductors, alternative embodiments may use the production tubing and the casing of the well as the coaxial conductors.

A wireless gauge system 240 is positioned near pump system 220. Wireless gauge system 240 includes a gauge subsystem 242 and a transmitter subsystem 244. Gauge subsystem 242 may include pressure and temperature sensors, as well as any other types of sensors that might be desirable. Gauge subsystem 242 receives power from a downhole power subsystem 246. Power subsystem may use various means to generate power downhole, or may receive power via the coaxial conductors 230. The generated or received power may be stored in a battery or other energy store of the power subsystem. Power subsystem 246 is also coupled to transceiver subsystem 244. Transceiver subsystem 244 receives data from gauge subsystem 242 and wirelessly transmits this data (using power from power subsystem 246) via coaxial conductors 230 to a transceiver 252 of surface control system 250. The received data can then be used by a drive controller 254 of the surface control system 250 to control the operation of drive 210.

Gauge system 240 is wireless. In other words, the system does not include wires or cables through which data can be communicated from the gauge to the surface equipment. Likewise, there are no wires or cables through which power can be provided to the gauge. Gauge system 240 therefore includes a local energy store to provide its own power to gauge subsystem 242 and transmitter subsystem 244. In some embodiments, the subsystem may include components for local generation of power (e.g., from frictional heating), or the power may be supplied wirelessly through the coaxial conductors (e.g., rod and production tubing), as will be discussed in more detail below.

Figure 3:
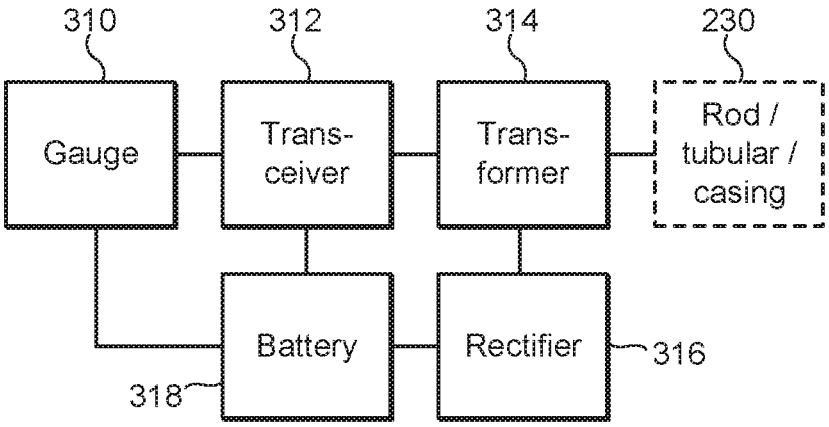
FIG. 3 is a functional block diagram illustrating the structure of a downhole portion of a wireless communication subsystem in accordance with some embodiments.

Referring to FIG. 3, a functional block diagram illustrating the structure of the wireless gauge subsystem in one embodiment is shown. In this embodiment, wireless gauge subsystem 240 includes a gauge 310, a transceiver 312, a toroidal transformer 314, a rectifier 316 and a battery 318. Toroidal transformer 314 inductively couples transceiver 312 to the pair of coaxially arranged conductors (which may comprise the rod and the production tubing, or the production tubing and the casing) so that data can be transmitted to the surface controller via these conductors, or received from the surface controller via these conductors. In this embodiment, toroidal transformer 314 also inductively couples rectifier 316 to the pair of coaxially arranged conductors so that power can be conveyed from the surface equipment to the rectifier, which can then provide rectified output power to battery 318.

Figure 4:
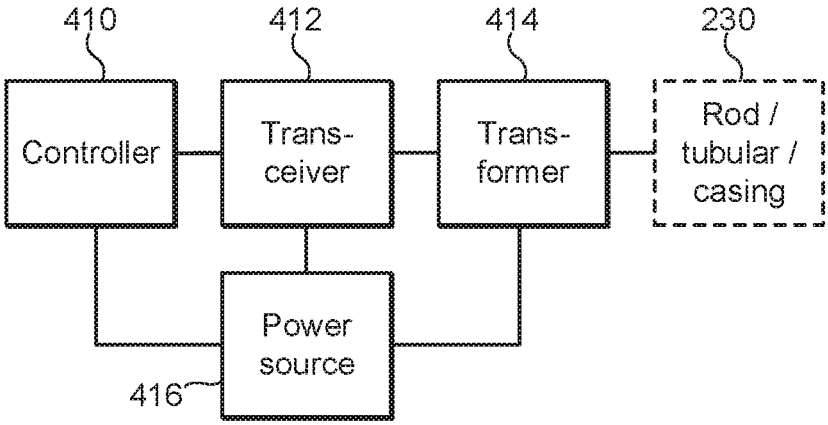
FIG. 4 is a functional block diagram illustrating the structure of a surface portion of a wireless communication subsystem in accordance with some embodiments.

Referring to FIG. 4, a functional block diagram illustrating the structure of the wireless controller subsystem for the surface equipment in one embodiment is shown. In this embodiment, wireless controller subsystem 250 includes a controller 410, a transceiver 412, a toroidal transformer 414, and a power source 416. Toroidal transformer 414 inductively couples transceiver 412 to the pair of coaxially arranged conductors so that data can be received from the downhole wireless gauge via these conductors, or transmitted to the downhole wireless gauge via the conductors. Toroidal transformer 414 also serves to inductively couple power source 416 to coaxially arranged conductors 230 so that power can be provided to the downhole wireless gauge via these conductors.

One exemplary type of communication subsystem uses a toroid coupled line (TCL) to wirelessly communicate data from the gauge subsystem to the surface control system. Rather than using wires or cables which may be damages in the harsh downhole environment, the TCL subsystem uses the electrically conductive pump rod and production tubing as a transmission line. The transmitter uses a toroidal coil to induce electrical currents that flow through the rod and production tubing (which are electrically coupled to form a complete circuit). The transmitter generates an AC signal which is applied to the toroidal coil, which in turn induces current in the rod and production tubing, with one serving as the electrical transmission pathway and the other serving as the electrical return pathway. A second toroidal coil is provided at the upper ends of the rod and production tubing to sense the induced currents and to provide a corresponding electrical signal to the surface control system.

Figure 5:
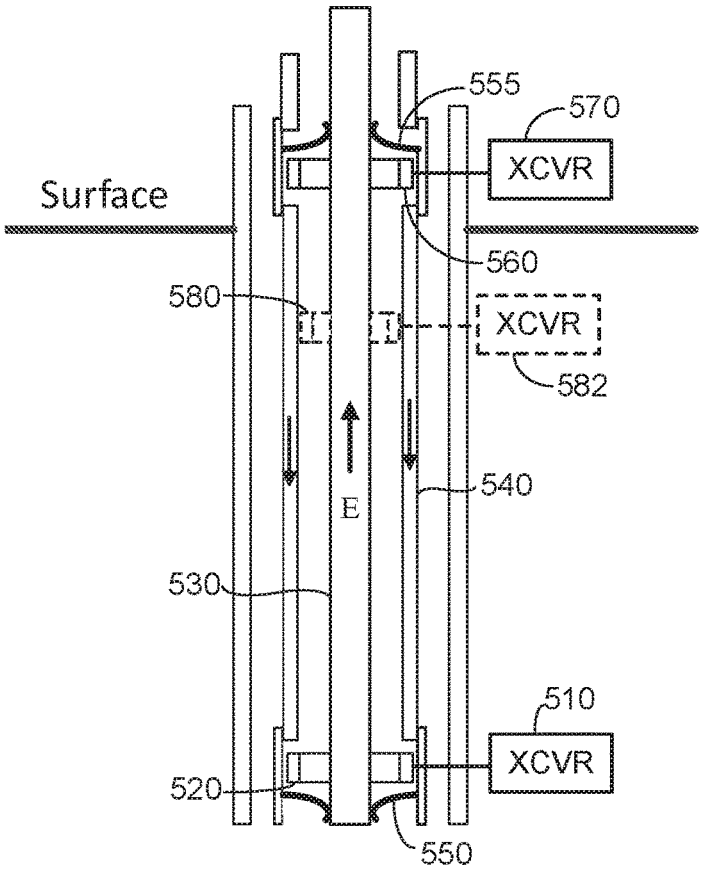
FIGS. 5-7 are diagrams illustrating the physical and electrical structure of a toroid coupled line communication system and toroidal coil in accordance with some embodiments.
Figure 6:
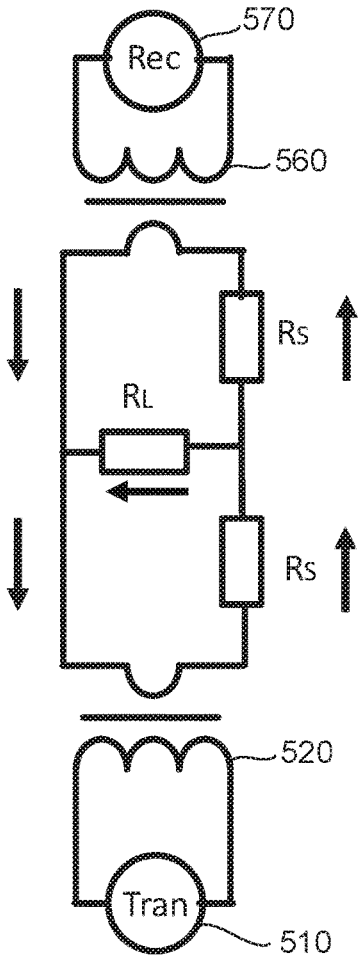
Figure 7:
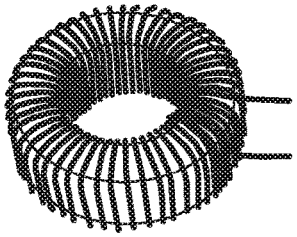

This is depicted in FIGS. 5-7. FIG. 5 is a diagram illustrating the physical structure of the TCL communication system. FIG. 6 is a diagram illustrating the electrical structure of the TCL communication system. FIG. 7 is a diagram illustrating the physical structure of the TCL's toroidal coil.

As depicted in these figures, a downhole transceiver 510 which is coupled to the gauge and power subsystems generates a signal that is provided to toroidal coil 520. In one embodiment, the transceiver and toroidal coil are positioned in proximity to an pump (e.g., ESP) which is installed in the well. These signals induce currents in pump rod 530 and production tubing 540. Rod 530 and tubing 540 are electrically coupled by conductors 550, 555 to form a complete circuit or pathway for the induced currents. Conductor 550 electrically connects the rod and production tubing below transmitting toroidal coil 520, while conductor 555 electrically connects the rod and production tubing above a second toroidal coil 560 which is coupled to a transceiver 570. Toroidal coil 560 and transceiver 570 in this embodiment are positioned at the surface of a well (e.g., the coil may be incorporated into a wellhead). The currents that are induced in the rod and production tubing by toroidal coil 550 are sensed by second toroidal coil 560. In other words, the currents in the rod induce an electrical potential in the second toroidal coil. The potential of second toroidal coil 560 is applied to transceiver 570, thereby communicating the transmitted signal to the transceiver. Because no conductors other than the pump rod and production tubing are needed (i.e., no conventional wires or cables are required), this system is considered to be "wireless" for the purposes of this disclosure.

It should be noted that a third coil (580) and corresponding transceiver (582) are shown in FIG. 5. These components are optional and are therefore depicted using dashed lines. This is intended to illustrate the fact that the TCL system may be used as a multi-point communication system. In other words, information may be communicated through the rod to other transceivers which may be positioned between the downhole and surface transceivers. In one embodiment, the transceivers may transmit and receive information at different frequencies in order to establish different channels between them.

Referring to FIG. 6, a circuit diagram representative of the system of FIG. 5 is shown. As depicted in this figure, transceiver 510 can function as a transmitter which generates electrical signals that are applied to the toroidal coil 520. Since coil 520 is positioned around rod 530, they operate as a transformer, with the toroidal coil as the primary winding of the transformer and the rod as the secondary winding. The current in the coil therefore induces current in the rod. This current flows through the rod and back through the tubular. The rod has some resistance Rs, so there are resistive losses which cause the voltage to drop across the length of the rod. There are also some losses due to leakage ($R_L$) between the rod and the tubular. The losses due to the leakage will vary, depending on the fluid that occupies the annular space between the rod and the tubular. At the upper end of the system, the rod serves as a winding of a second transformer that is formed in conjunction with toroidal coil 560. The current in the rod therefore induces current in coil 560. This current is sensed by transceiver 570, functioning as a receiver. The waveform of the sensed current is decoded to obtain the data that was sent by transmitting transceiver 510. The data can then be processed, consumed, displayed, or otherwise used.

It should also be noted that the system can operate bidirectionally, with transceiver 570 generating data signals and applying the signals to toroidal coil 560, which induces current in rod 530, in turn inducing current in coil 520 that can be sensed, decoded and used as needed by the downhole tool.

Referring to FIG. 7, the structure of an exemplary toroidal coil in this embodiment is shown. It can be seen from the figure that the toroidal coil is formed by wrapping wire around a toroidal (donut-shaped) ferromagnetic core. The wire is wrapped non-circumferentially. That is, each turn of the wire is substantially co-planar with the axis of symmetry of the toroidal core. This results in a circular magnetic field within the core and an electric field in the opening in the center of the toroidal coil. Since the toroidal coil is placed around the rod (and inside the production tubing), the generated electric field induces current in the pump rod that is positioned within the opening in the toroidal coil.

In another alternative embodiment, the rod can be used in conjunction with the well casing as a return pathway, or the production tubing and casing can be used as transmission and return pathways. In yet another embodiment, a coaxial transmission line can be formed by two of: the rod, the production tubing, and the well casing.

Figure 8:
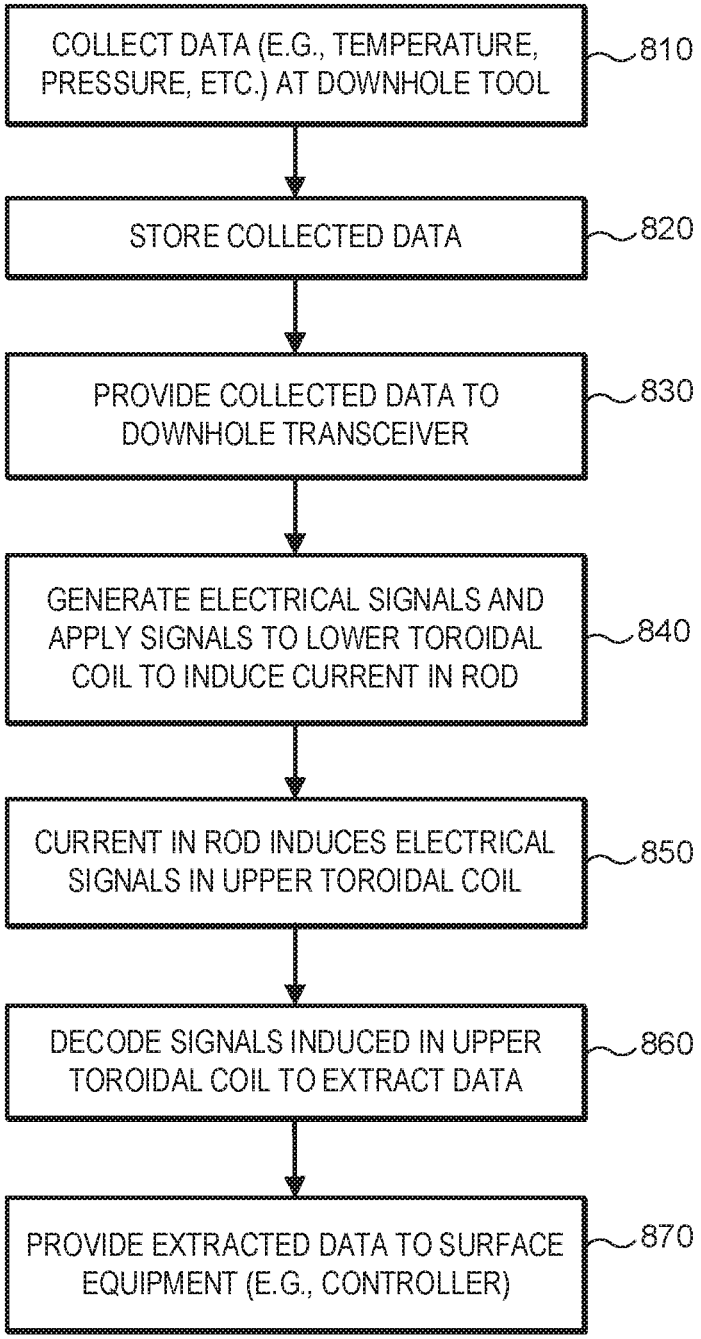
FIG. 8 is a flow diagram illustrating a method for communicating using a toroid coupled line in accordance with some embodiments.

Referring to FIG. 8, a flow diagram illustrating a method for communicating using a toroid coupled line in accordance with some embodiments is shown. This figure summarizes operation of the system described above.

In this embodiment, a downhole tool first collects data (810). For example, the downhole equipment may include a sensor which measures hydrostatic pressure at a downhole pump, which corresponds to a water level at the pump. The data from the sensor is stored in a local memory until the collected data can be transmitted to a surface controller (820). Periodically, the stored data will be provided to a transceiver which generates electrical signals which embody the data (830). The transceiver is connected to a toroidal coil which is positioned around a lower end of a rod which drives the pump. The electrical signals generated by the transceiver are applied to the coil, which causes corresponding currents to be induced in the rod (840). These currents are carried through the pump rod and cause electrical potentials corresponding to the current to be induced in a toroidal coil positioned at an upper end of the rod (850). The electrical potentials induced in the coil are processed by a transceiver coupled to the coil, thereby decoding the potentials to extract from the signal the data which was originally transmitted by the downhole transceiver (860). This data is then provided to a pump controller or some other equipment at the surface of the well for processing or display (870).

As noted above, there are losses in the transmission of data from the downhole equipment to the surface, including resistivity losses and leakage losses. These losses vary with the frequency of the data that is transmitted, as well as the medium (e.g., brine) contained in the annular space between the rod and the tubular. Additionally, while the resistivity losses between the two toroidal coils remain substantially constant for a particular frequency, the overall leakage losses may change as a result of the amount and conductivity of the fluid in the annular space. The greater the conductivity of the liquid, the higher the losses will be. Similarly, the greater the length of the occupied by the liquid, the greater the losses will be. Thus, the voltage transfer (Vout/Vin) over the length of the system is dependent upon these factors.

Figure 9:
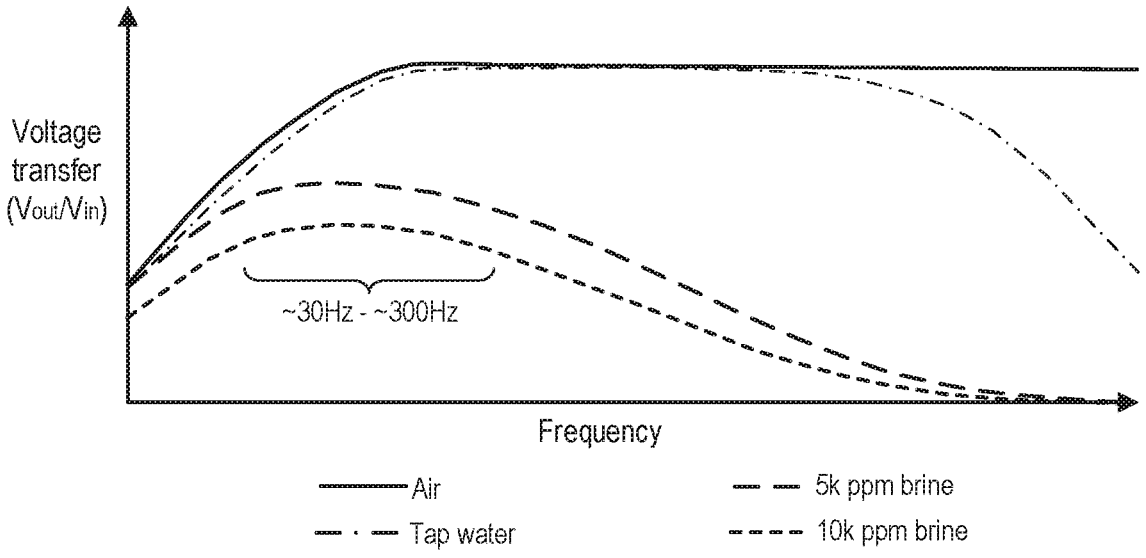
FIG. 9 is a diagram illustrating the voltage transfer as a function of frequency and the medium in the annular space in one embodiment.

Referring to FIG. 9, a diagram illustrating the voltage transfer as a function of frequency and the medium in the annular space in one embodiment is shown. In this figure, the system is assumed to have a fixed length (e.g., 60 feet) between the two toroidal coils, and the annular space over this entire length is filled with the indicated medium. Curves are depicted for each of four media: air; tap water; 5000 ppm (parts per million) brine; and 10,000 ppm brine.

It can be seen in the figure that the voltage transfer is greatest when the annular space is filled with air. At very low frequencies, the transfer function is relatively low, but it rises relatively rapidly as the frequency approaches 100 Hz, then begins to level off and remains at a high level as the signal frequency is increased to 100 kHz. When the annular space is filled with tap water, the voltage transfer is slightly lower, but very similar to that of air up to about 100 Hz. The curve stays near its maximum from about 100 Hz to 5 kHz, then decreases above 5 kHz. The curves for 5 kppm brine and 10 kppm brine are significantly lower, with their maximum performance falling between about 30 Hz and 300 Hz.

In an actual installation, the distance between the lower toroidal coil and the upper toroidal coil may be hundreds, or even thousands of feet. Usually, only a portion of the overall length of the annular space will be filled with fluid. The portion of the annular space which is occupied by liquid (e.g., brine) and the portion which is occupied by air may vary, so the overall leakage losses may change, but it is not uncommon for the liquid to fill approximately 50 feet of the annular space. Thus, although the signal may drop by approximately half (in the range from 30 Hz to 300 Hz) through the liquid-filled portion of the conduit, the air-filled portion will experience a much smaller drop. The system may therefore be useful in even deep wells, particularly when using signals in the 30 Hz-300 Hz range.

Figure 10:
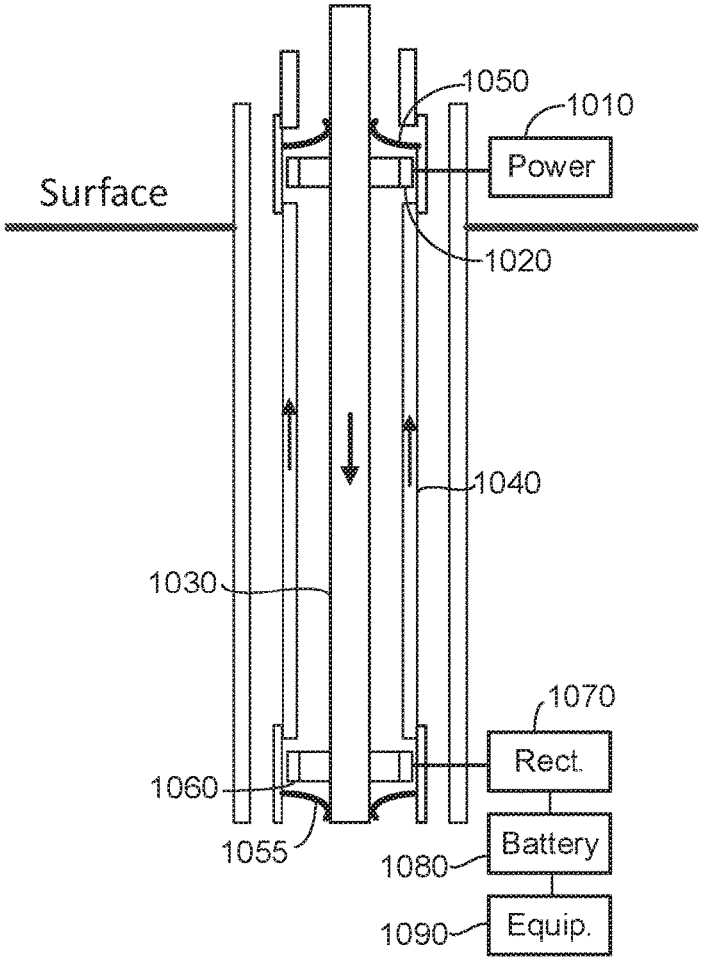
FIG. 10 is a diagram illustrating the physical structure of a TCL power transmission system in accordance with some embodiments.
Figure 11:
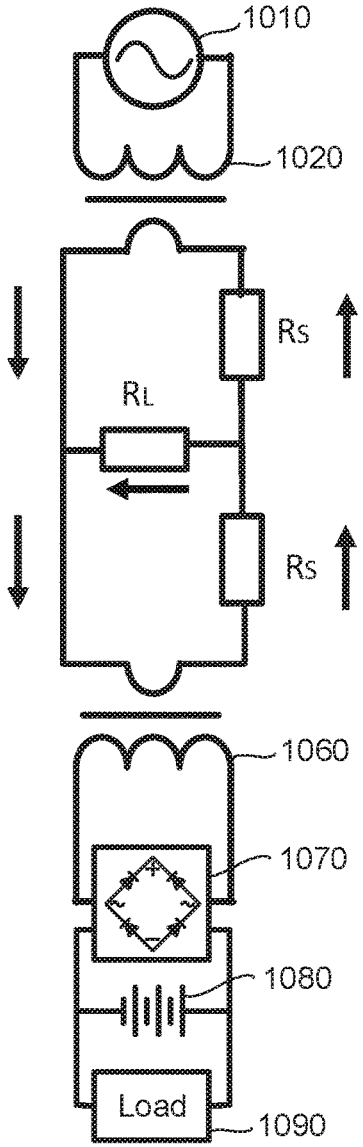
FIG. 11 is a diagram illustrating the electrical structure of a TCL power transmission system in accordance with some embodiments.

As noted above, the TCL system can be used to transmit power as well as data. For example, power that is generated at the surface of the well may be communicated via the TCL system to equipment installed downhole in the well, which can be consumed immediately, or stored for later use by the downhole equipment. The structure of a power transmission system in accordance with some embodiments is illustrated in FIGS. 10-11. FIG. 10 is a diagram illustrating the physical structure of the TCL power transmission system. FIG. 11 is a diagram illustrating the electrical structure of the system.

As shown in these figures, a power source 1010 is coupled to an upper toroidal coil 1020. The toroidal coil is positioned around a pump rod 1030 which extends downhole into the well within tubular 1040. A lower toroidal coil 1060 is positioned around the rod at a downhole location near a piece of downhole equipment which requires power from the surface.

In this case, AC power is provided by power source 1010. The AC voltage signals generated by source 1010 are applied to toroidal coil 1020, generating magnetic fields which induce currents in rod 1030. Electrical conductors 1050 and 1055 electrically couple rod 1030 to tubular 1040 in order to form a complete circuit through which current can flow. The current induced in rod 1030 induces a voltage in lower toroidal coil 1060. This voltage is provided to a rectifier 1070 which rectifies the AC power to DC. The DC power is then provided to a battery 1080, charging the battery. When needed, equipment 1090 can draw power from battery 1080, enabling the equipment to operate.

Figure 12:
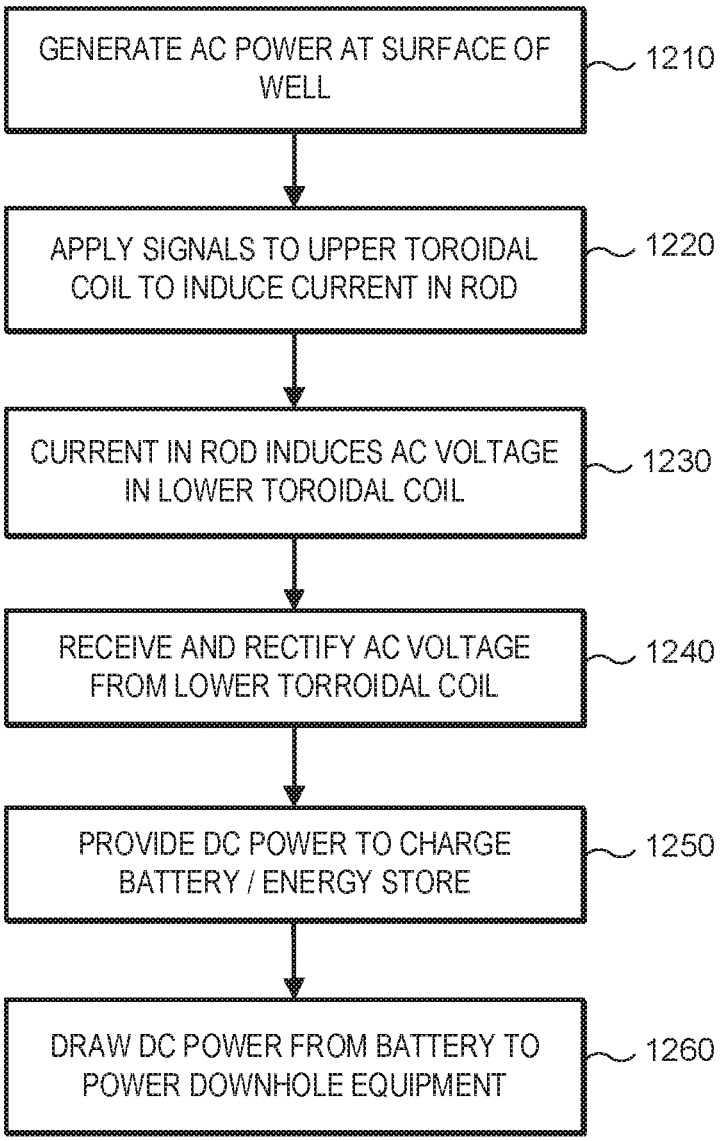
FIG. 12 is a flow diagram illustrating a method of operating a power transmission system using a toroid coupled line in accordance with some embodiments.

The operation of this TCL power transmission system is illustrated in FIG. 12. This figure is a flow diagram showing a method for generating and transmitting power to downhole electric equipment in accordance with some embodiments. As depicted in this figure, AC power is initially generated by equipment positioned at the surface of a well (1210). The power may be generated, for example, by a drive system that is configured to draw power from a source such as a power grid or generator and to generate an AC output voltage that is suitable for transmission to the downhole equipment. These AC voltage signals are applied to an upper toroidal coil (e.g., coil 1020), causing current to flow through the coil. This current causes the coil to generate magnetic fields which induce currents in the rod or tubular (e.g., 1030) in the well (1220). The current flowing through the rod or tubular generates magnetic fields at the lower toroidal coil, thereby inducing a corresponding AC voltage in this coil (1230). The AC voltage will have the same frequency as the AC voltage applied to the upper toroidal core, but will have a reduced magnitude due to losses resulting from transmission of the current through the rod or tubular (including resistive and leakage losses). The voltage induced in the lower toroidal coil is provided in this embodiment to a rectifier which is coupled to the coil to convert the AC voltage to a DC voltage (1240). This DC voltage is applied to the terminals of a battery, super capacitor, or other energy storage device, thereby charging the device (1250). The AC voltage and/or DC voltage may be conditioned as desired or necessary to produce a voltage suitable for charging the energy storage device. The power stored in the energy storage device may then be drawn by a piece of downhole equipment such as a sensor, data collection device, transmitter, etc. to operate the equipment (1260).

Although in this embodiment power is transmitted from a surface power source to a single piece of equipment that is installed downhole in a well, it is possible in alternative embodiments for power to be transmitted in the same manner to several different locations within the well. For example, one or more additional toroidal coils which are coupled to corresponding additional pieces of downhole electric equipment may be positioned at different axial locations, so that the current in the rod or tubular induces voltages in each of these downhole toroidal coils, providing power to each of the corresponding pieces of equipment. In other alternative embodiments, the power source may be located in the well, and may provide power to equipment at other locations within the well. For instance, a downhole electric generator may be installed in the well at a first axial position, and power from this generator may be provided to equipment which is co-located with the generator, as well as being provided via a TCL system as described above to equipment located at a second axial position in the well. Exemplary friction-based downhole power generators are described in more detail below. The operation of the TCL system would be the same as described above for transmission of power from a surface-based source.

Figure 13:
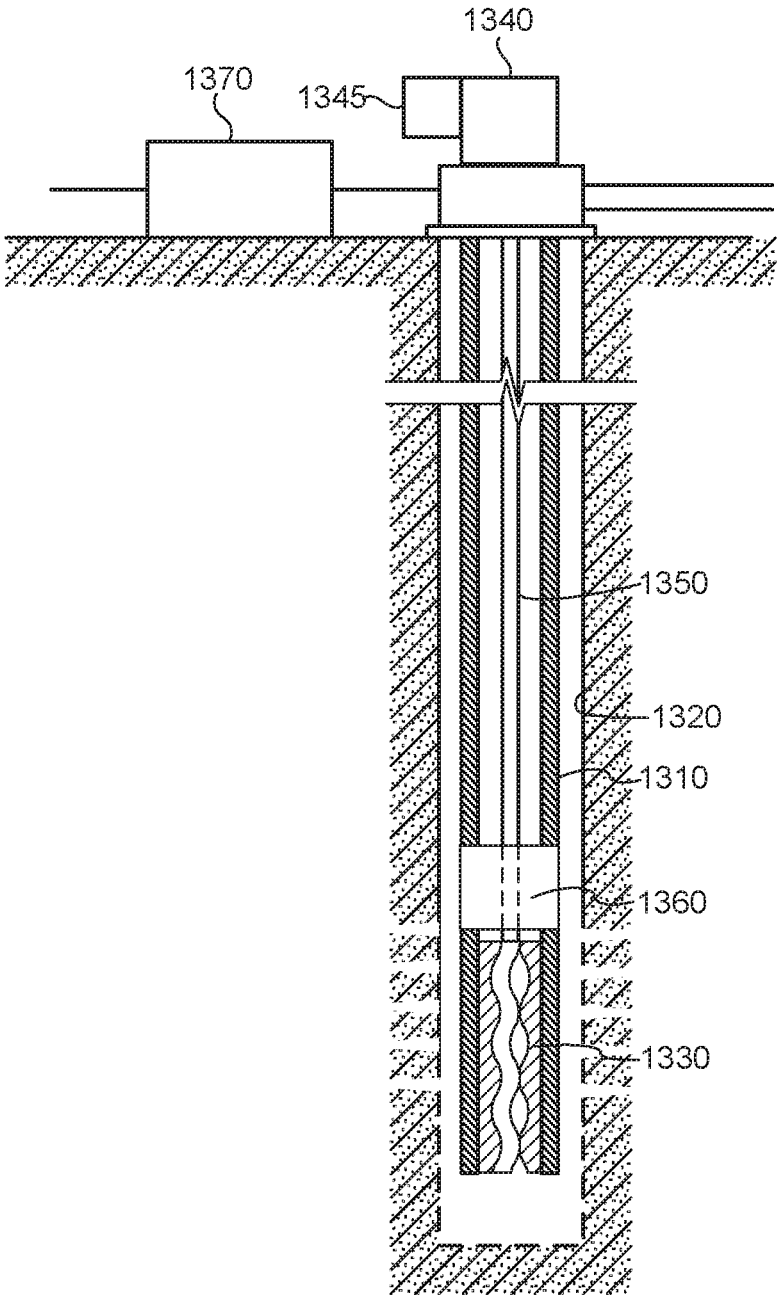
FIG. 13 is a diagram illustrating an exemplary system wireless communication system for a downhole tool in accordance with one exemplary embodiment.

Referring to FIG. 13, a diagram illustrating an exemplary system for wirelessly generating power downhole in accordance with some embodiments is shown. The well depicted in this figure may be representative of a coal seam gas well. Gas enters the well through perforations in the casing and formation and flows upward through the annular space between the casing of the well and production tubing 1310 that is installed in the well. Water may also enter the well from the surrounding formation, and when the water levels are too high, the water impedes the flow of gas into the well. The water must therefore be periodically removed from the well to allow gas to be efficiently produced from the well.

As shown in FIG. 13, production tubing 1310 is installed in the case well 1320. A PCP 1330 is installed downhole in the well to enable the periodic removal of water from the well. A drive 1340 for PCP 1330 is installed at the surface of the well and is coupled to PCP 1330 by a rod 1350. Drive 1340 is driven by prime mover 1345 to rotate rod 1350. Rod 1350 in turn rotates a rotor of PCP 1330 within a stator of PCP 1330, causing water and suspended coal fines (as well as any other liquids that may have accumulated in the well) to be pumped up through production tubing 1310 and out of the well.

A wireless gauge 1360 is installed downhole in the well near PCP 1330. Wireless gauge 1360 in this embodiment is configured to monitor the pressure of the water in the well and to communicate this information to a controller 1370 at the surface of the well. Surface controller 1370 is coupled to drive 1340 and prime mover 1345 and is configured to cause these units to drive rod 1350 and PCP 1330 as needed to remove water from the well. When the water level in the well is low enough to allow gas to be produced, surface controller 1370 controls driver 1340 and prime mover 1345 to stop, suspending operation of PCP 1330 so that pump off conditions do not cause overheating of PCP 1330.

Figure 14:
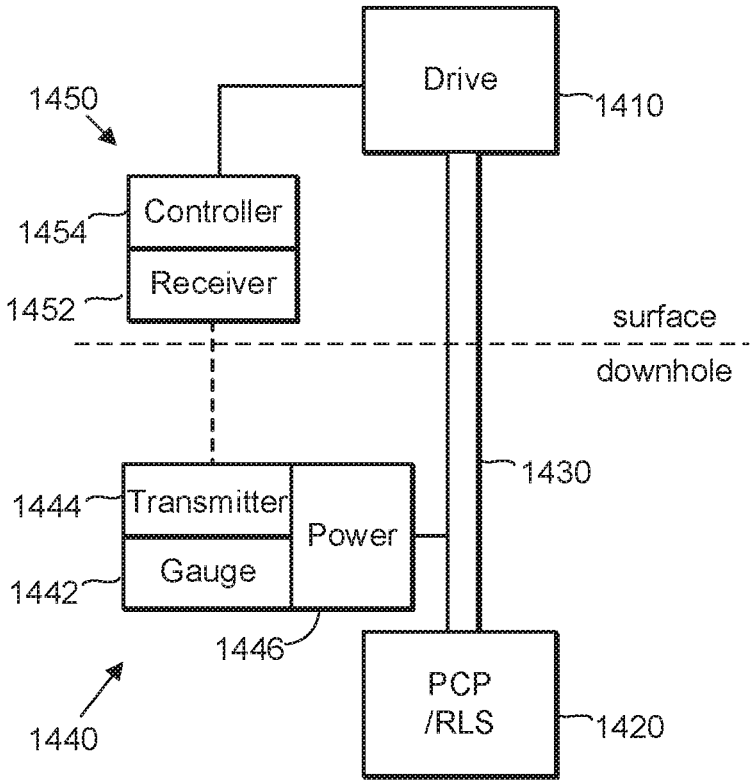
FIG. 14 is a functional block diagram illustrating the general relationship of the components of a pump system and wireless gauge in accordance with one embodiment.

Referring to FIG. 14, a functional block diagram illustrating the general relationship of the components of a pump system and wireless gauge in one embodiment is shown. As shown in this figure, a drive system 1410 is coupled to a pump system 1420 by a rod 1430. Pump system 1420 may use a PCP-type or RLS-type pump. In the case of a PCP-type pump, rod 1430 rotates, thereby rotating a rotor of the PCP-type pump. In the case of an RLS-type pump, rod 1430 moves in a reciprocating motion, thereby causing a mover of the RLS-type pump to move in a reciprocating motion. This motion is generally in alignment with the axis at the center of the rod.

A wireless gauge system 1440 is positioned near pump system 1420. Wireless gauge system 1440 includes a gauge subsystem 1442 and a transmitter subsystem 1444. Gauge subsystem 1442 may include pressure and temperature sensors, as well as any other types of sensors that might be desirable. Gauge subsystem 1442 receives power from a power subsystem 1446 which is coupled to rod 1430. Power subsystem 1446 is also coupled to transmitter subsystem 1444. Transmitter subsystem 1444 receives data from gauge subsystem 1442 and wirelessly transmits this data (using power from power subsystem 1446) to a receiver 1452 of surface control system 1450. The received data can then be used by a drive controller 1454 of the surface control system 1450 to control the operation of drive 1410.

Because gauge system 1440 is wireless, it must provide its own power to gauge subsystem 1442 and transmitter subsystem 1444. This power is provided by a power subsystem 1446, which includes components for generation of power from frictional heating and components for storage of the generated power. As will be described in more detail below, the power generation components include a thermoelectric generator which uses temperature differentials to produce an electrical potential. This potential is used to charge a battery, capacitor or other energy storage device. The energy stored in this device is then used as needed to power gauge subsystem 1442 and transmitter subsystem 1444.

Figure 15:
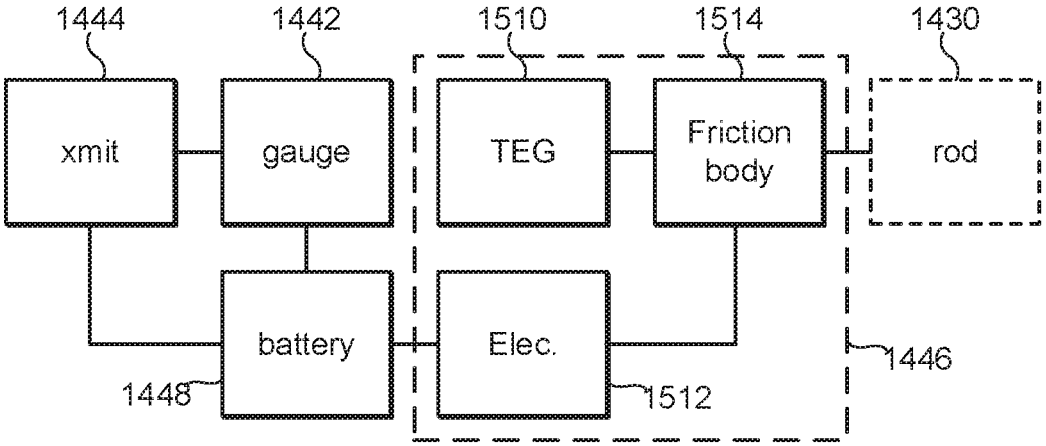
FIG. 15 is a functional block diagram illustrating the structure of the wireless gauge subsystem in accordance with one embodiment.

Referring to FIG. 15, a functional block diagram illustrating the structure of the wireless gauge subsystem in one embodiment is shown. In this embodiment, wireless gauge subsystem 1440 includes a gauge 1442, a transmitter 1444, and power subsystem 1446, and a battery 1448. Power subsystem 1446 uses a TEG 1510 that has a hot side and a cold side. When there is a differential between a first temperature applied to the hot side and a second temperature applied to the cold side, TEG 1510 generates an electrical potential. The greater the temperature differential, the more power is produced by the TEG. This electrical potential is applied to electrical circuitry 1512 which may process the received power before providing it to battery 1448.

Figure 16:
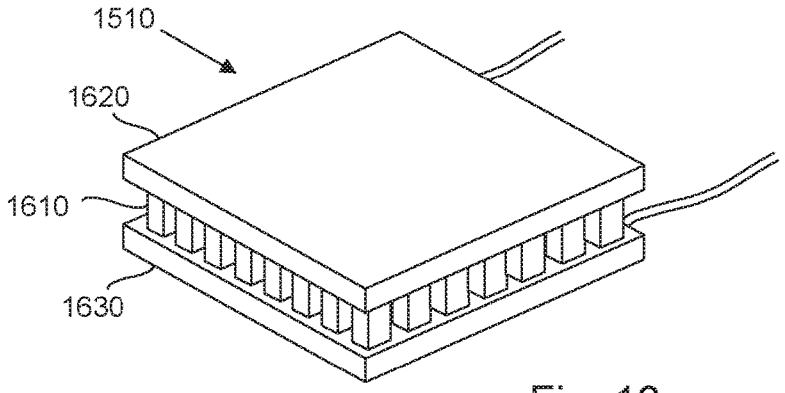
FIG. 16 is a depiction of an exemplary TEG device in accordance with one embodiment.

An example of a typical TEG is depicted in FIG. 16. This device operates based upon the Seebeck effect, in which heat flux (temperature differences) are converted directly into electrical energy. The device may therefore also be referred to as a Seebeck generator. This type of device has solid state construction, provides high-temperature operation, generates no sound or vibration, and operates reliably in temperatures of up to 150 C. It can generate up to hundreds of watts of power, depending upon the design and temperature differential.

The TEG of FIG. 16 is manufactured using blocks of semiconductor material 1610 positioned between plates (1620 and 1630) on the hot and cold sides of the device. The semiconductor materials are selected for characteristics that include both high electrical conductivity and low thermal conductivity. TEG's having many different physical configurations and providing a wide range of performance are commercially available. It should be noted that one or multiple TEG devices may be used in various embodiments, so references herein to "TEG" should be construed to include both individual TEG devices and sets of TEG devices.

In the systems disclosed herein, the hot side of TEG 1510 is exposed to heat that is generated by friction with the rod coupling the surface drive to the pump system. This frictional heating is provided in some embodiments by placing a "friction body" in thermal contact with both the rod and the hot side of TEG 1510. As the friction body moves against the surface of the rod (which may be referred to herein as a "friction surface"), frictional heating is generated, and this heat energy is conducted through the friction body to the hot side of TEG 1510. A "friction body" may be any structure coupled to the TEG that is used to generate frictional heating. The friction body is not strictly necessary, but may be used, for example, to reduce wear and mechanical stress on the TEG itself.

In some embodiments, the TEG and the friction body may remain in substantially static positions while the rod moves (either rotating or linearly reciprocating), so that there is friction between the friction body and the friction surface on the rod. In other embodiments, the TEG and the friction body may be mounted on the rod so that they move with the rod. In this case, the friction body will move with respect to a stationary component that is positioned adjacent to the rod and provides a friction surface, so that frictional heat is generated between the friction body and this stationary friction surface when the rod and the friction body move.

The friction body may have any suitable configuration. The friction body may, for example, comprise a simple pad positioned between and in direct contact with the TEG and the rod. In some embodiments, the friction body may have a more complex configuration (e.g., it may be in thermal contact with a heat pipe, and the heat pipe may be coupled to transfer heat energy to the hot side of the TEG).

In some embodiments, the cold side of the TEG is positioned so that it is exposed to the space between the production tubing and the rod that drives the pump system. The cold side of the TEG is cooled by fluids flowing through this space. Heat pipes may be used to transfer heat from the cool side of the TEG to locations within the production tubing that are cooler than the location of the TEG itself. In other embodiments, the cold side of the TEG may be positioned so that it is exposed to the annular space between the production tubing and the well casing (or wellbore). The gas which is produced from a typical coal seam gas well flows through this annular space from the producing region of the well to the surface. The flowing gas serves as a cooling medium for the cold side of the TEG. The device may be configured to expose the cold side of the TEG directly to this cooling flow of gas, or means such as heat pipes may be used to transfer heat energy from the cold side of the TEG to the gas.

Figure 17:
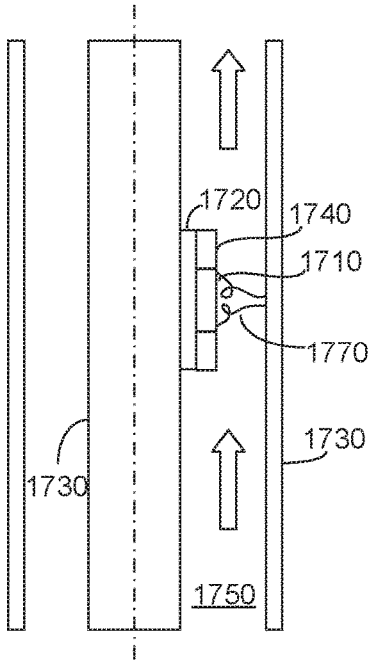
FIG. 17 is a diagram illustrating the configuration of the TEG in an exemplary power subsystem in accordance with one embodiment.

Referring to FIG. 17, a diagram illustrating the configuration of the TEG in an exemplary power subsystem is shown. In this embodiment, a TEG 1710 is mounted on a friction body 1720 which is itself in contact with rod 1730. Friction body 1720 is designed to function in essentially the same manner as a brake pad, providing frictional contact with the rod 1730 and generating heat as the rod moves against it (i.e., rotates or moves in a linearly reciprocating motion). Thermal insulation material 1740 is positioned around the sides of TEG 1710 to provide thermal separation between the cold side of the TEG and the heat generated by friction against rod 1730. Although not shown in the figure, additional thermal insulation may be positioned around friction body 1722 cause more of the generated frictional heat to be provided to the hot side of TEG 1710.

In this embodiment, TEG 1710 is potted with the cold side of the TEG exposed to the annular space 1750 between rod 1730 and production tubing 1760. The cold side of the TEG is therefore submersed in the fluid in this annular space. As fluid flows through this space (as indicated by the arrows in the figure), the fluid absorbs heat from the cold side of TEG 1710, maintaining a temperature differential between the cold side and the hot side of the device. Electrical conductors 1770 extend from TEG 1710 to electrical circuitry and/or an energy storage device (e.g. capacitor or battery), where the generated electrical energy is stored. The stored electrical energy is then used by the gauge and wireless transmitter subsystems.

It should be noted that, although FIG. 17 shows a single TEG positioned on one side of rod 1730, multiple TEG devices may be positioned around the rod to provide additional heat generation and additional electrical power generated from the heat.

Figure 18A:
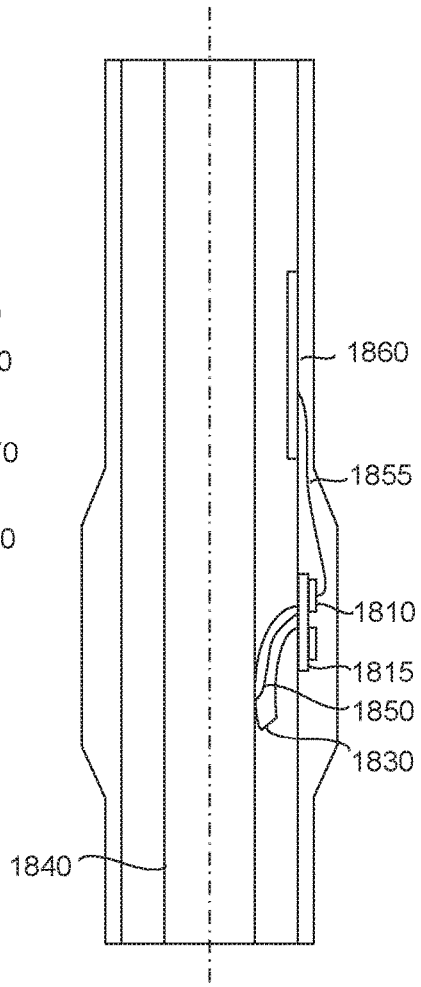
FIGS. 18A-18B are diagrams illustrating the configuration of the TEG in a power subsystem in accordance with alternative, spring-arm embodiments.

Referring to FIG. 18A, a diagram illustrating the configuration of the TEG in an alternative power subsystem is shown. In this embodiment, a one or more TEGs 1810 are mounted on a plate 1815 in the housing of a gauge sub 1820. A spring arm 1830 is connected to plate 1815 and extends from the interior wall of the gauge sub housing to the exterior surface of rod 1840. A friction body attached to the end of spring arm 1830 contacts rod 1840 and frictional heating is caused by movement of the friction body against the rod when the rod moves in a rotational or reciprocating linear motion. A first heat pipe 1850 is thermally coupled between the friction body and plate 1815 so that heat generated by the friction body is transferred through the first heat pipe to plate 1815. Insulation may be provided around the heat pipe to prevent the heat from being transferred to fluid between the gauge sub housing and the pump rod. This heat is then transferred from plate 1815 to the hot side of TEG(s) 1810. The cold side of TEG(s) 1810 is coupled by a second heat pipe 1855 to a heat sink 1860 that is positioned within the annulus between gauge sub housing 1820 and rod 1840. Heat sink 1860 is cooled by fluid flowing through this annular space. Heat is drawn from the cold side of TEG(s) 1810 through second heat pipe 1855 to heat sink 1860, thereby reducing the temperature of the cold side of the TEG(s) and maintaining a temperature differential between the hot and cold sides of the device(s).

Figure 18B:
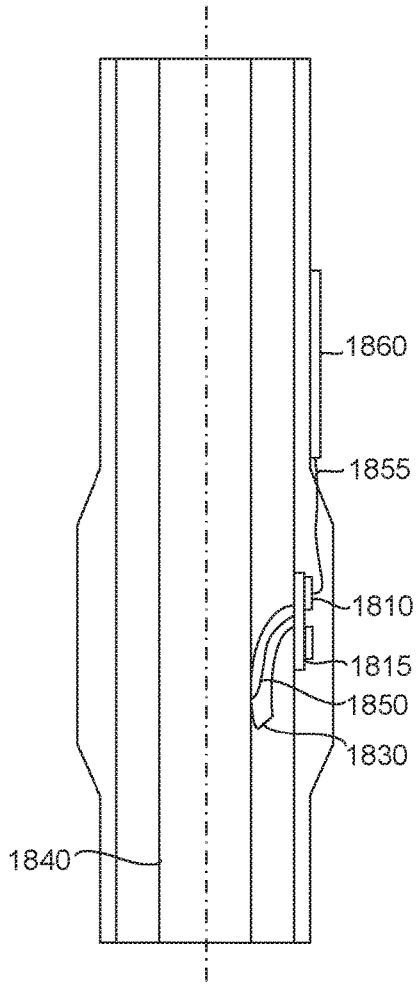

Referring to FIG. 18B, a diagram illustrating another alternative configuration of the TEG is shown. In this embodiment, the TEG is mounted in the gauge sub and is thermally coupled through a first heat pipe to a friction body at the end of a spring arm. Heat generated by movement of the friction body against the pump rod is transferred to the hot side of the TEG device. In this embodiment, the heat sink which is coupled to the cold side of the TEG by the second heat pipe is positioned on the exterior of the gauge sub housing rather than the interior. With this configuration, the heatsink is cooled by gas that flows through the annular space between the gauge sub housing and the well casing, rather than by fluid flowing between the gauge sub housing and the pump rod.

Figure 19C:
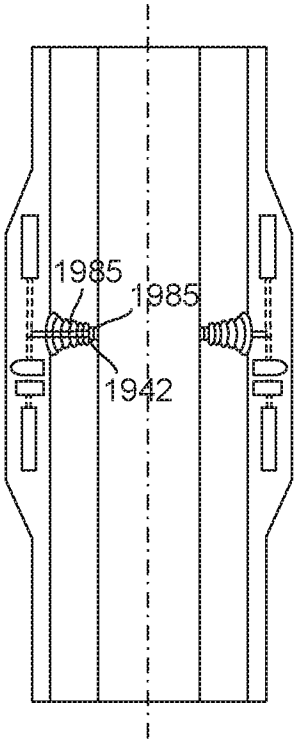
FIGS. 19A-19C are diagrams illustrating several exemplary configurations for mounting TEG's in a manner which maintains contact of the TEG's with the pump rod and centralizes the pump rod.
Figure 19B:
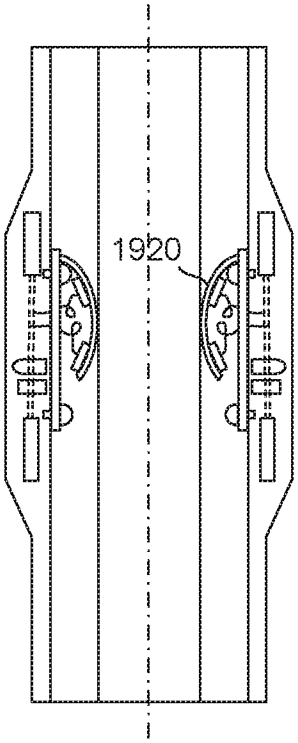
Figure 19A:
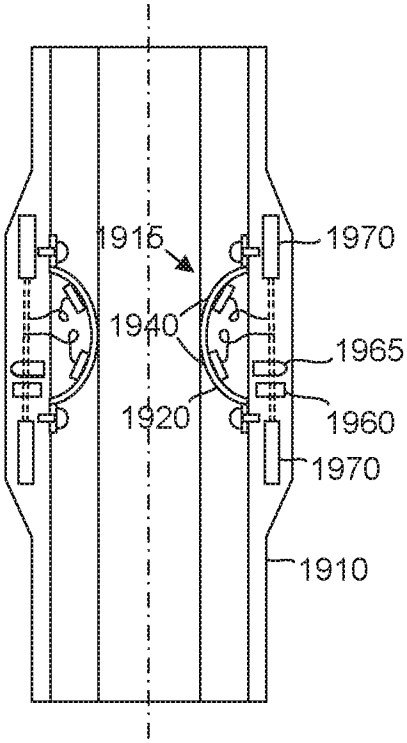

Referring to FIGS. 19A-19C, several exemplary configurations for mounting TEG's in a manner which maintains contact of the TEG's with the pump rod and centralizes the pump rod are shown. Referring specifically to FIG. 19A, a first exemplary embodiment uses leaf-type springs which serve as friction bodies to support the TEG's. As shown in the figure, multiple TEG assemblies 1915 are mounted on the gauge sub housing 1910. (Only two assemblies are shown in the figure, but three or more would be necessary to centralize the rod in the sub.) Each of these assembly has a leaf spring 1920, with each end of the spring secured to the interior wall of the gauge sub housing. A first, radially-inward facing surface of the leaf spring contacts pump rod 1930 and serves as the friction body for the assembly. The leaf springs are flexed slightly to press the first surface of the spring against the pump rod. This maintains frictional contact between the spring and the pump rod and, since there are multiple TEG assemblies, centralizes the rod within the gauge sub.

A pair of TEGs 1940 are mounted on the opposite (radially outward-facing) surface of the spring. As the pump rod moves against the first phase of the spring, the friction-generated heat is transferred through the spring to the hot side of the each of the TEG's. Since the TEG's are positioned very near the point at which the leaf spring contacts the pump rod, no heat pipe is used in this embodiment. The opposite, cold side of each TEG is exposed to the fluid flowing through the annular space between the pump rod and the gauge sub housing. The fluid cools this side of the TEG's and maintains the temperature differential between the hot and cold sides of the devices. Leads from the TEG's extend through a seal 1950 in the gauge sub housing and are connected to power electronics 1960, wireless transceiver 1965 and batteries 1970 that are mounted in the housing.

Referring to FIG. 19B, a second exemplary embodiment is similar to the embodiment of FIG. 19A, except that single-ended springs 1922 are used instead of leaf springs 1920 which have both ends connected to the gauge sub housing. Springs 1922 are flexed slightly to maintain contact with the pump rod so that frictional heating is generated when the pump rod moves. Springs 1922 also serve to centralize the rod within the gauge sub housing. The remainder of each TEG assembly in FIG. 19B is configured the same as the embodiment of FIG. 19A.

Referring to FIG. 19C, a third embodiment in which the TEG assemblies serve to centralize the pump rod within the gauge sub is shown. In this embodiment, a flexible, non-metal bellows 1980 supports a friction body 1985 and applies pressure to maintain contact of the friction body against pump rod 1930. Bellows 1980 may be manufactured from elastomeric materials such as rubber, neoprene, nitrile, ethylene-propylene, silicone or fluorocarbon. A TEG device 1942 is mounted behind friction body 1985 and in thermal contact with the friction body. Leads from TEG 1942 extend through the bellows to the power electronics and batteries mounted in the gauge sub housing. As in the embodiments of FIGS. 19A and 19B, this embodiment includes several of the TEG assemblies positioned at different circumferential locations around the pump rod in order to provide centralization of the pump rod.

Bellows 1980, in addition to providing contact between the friction body and pump rod and centralizing the pump rod, also serves to provide environmental isolation of the TEG device and associated electrical contacts and components from fluids (e.g., water) flowing through the annular space between the pump rod and the gauge sub housing. The bellows may therefore prevent corrosion and fouling that might otherwise result from exposure to these fluids. The bellows may also prevent some heat loss from the thermally conductive material of the friction body to the surrounding fluids.

The examples above show the TEG devices incorporated into stationary assemblies. The frictional heating is generated by contact between friction bodies in these stationary assemblies and the moving pump rod. As indicated above, the TEG devices and friction bodies may alternatively be incorporated into the pump rod itself (i.e., they. May be stationary with respect to the pump rod, rather than the pump stator). In these alternative embodiments, a stationary component such as a collar that encircles the pump rod may be provided, where the friction body rubs against the stationary component as the pump rod rotates or reciprocates, thereby generating heat that is converted to electricity by the TEG in the pump rod.

As noted above, the power generated by the TEG devices is stored (e.g., in batteries, capacitors or other energy storage devices) and the stored energy is then used to operate the gauge and wireless communication subsystems. The gauge subsystem may include pressure sensors, temperature sensors, or any other type of sensor that may be desired. (In some embodiments, the disclosed power generation subsystem may be used to drive tools other than gauges or communication systems.) The information that is provided by the gauge subsystem may be processed as needed and provided to a wireless communication subsystem (e.g., transmitter, receiver or transceiver) so that it may be communicated to the surface control system, which may then use the information to control the drive for the pump system. The wireless communication system may use any appropriate means (e.g., acoustic, electrical, magnetic, etc.) to communicate data to the surface control system. Several exemplary and non-limiting examples of suitable communication mechanisms are described below.

As used herein, a term preceded by "a" or "an" (and "the" when antecedent basis is "a" or "an") includes both singular and plural of such term unless the context clearly dictates otherwise. Also, as used in the description herein, the meaning of "in" includes "in" and "on" unless the context clearly dictates otherwise.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such nonlimiting examples and illustrations includes, but is not limited to: "for example," "for instance," "e.g.," "in one embodiment."

Reference throughout this specification to "one embodiment," "an embodiment," or "a specific embodiment" or similar terminology means that a particular feature, structure, or characteristic described in connection with the embodiment is included in at least one embodiment and may not necessarily be present in all embodiments. Thus, respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

Although the steps, operations, or computations may be presented in a specific order, this order may be changed in different embodiments. In some embodiments, to the extent multiple steps are shown as sequential in this specification, some combination of such steps in alternative embodiments may be performed at the same time. The sequence of operations described herein can be interrupted, suspended, or otherwise controlled by another process.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/figures should be considered only as exemplary, and not limiting, unless otherwise specifically noted.

Use of the embodiments disclosed herein may provide a number of advantages over prior art systems that have wired communication systems. For example, disclosed embodiments are suitable for measuring the hydrostatic head in coal seam gas wells on a continuous basis, allowing timely decisions on PCP on/off operation sequences depending on water and gas production rates from the formation. These embodiments avoid problems relating to entanglement of wired gauges during deployment of PCP strings into wells and the extraction of PCP strings from wells. These embodiments also avoid problems relating to gauge failure due to damaged cables or loss of electrical connectivity. Embodiments further avoid the need to kill wells and suffer possible production losses. Embodiments may avoid the cost of spooling units and may reduce installation crews (from 2 people to 1 person).

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A system comprising:

a first structural member of a well completion;

a second structural member of the well completion, wherein the first and second structural members are coaxially positioned with an annular space between the first structural member and the second structural member, wherein a first portion of the annular space is filled with a well fluid and a second portion of the annular space is filled with air;

a first electrical coupling between the first structural member and the second structural member at a first axial location;

a second electrical coupling between the first structural member and the second structural member at a second axial location, wherein the first structural member, the second structural member, the first electrical coupling and the second electrical coupling form a first electrical circuit;

a first toroidal transformer positioned around the second structural member at a third axial location which is between the first axial location and the second axial location;

a second toroidal transformer positioned around the second structural member at a fourth axial location which is between the first axial location and the second axial location;

a transmitter coupled to the first toroidal transformer, wherein the transmitter is configured to generate a data signal, wherein when the data signal is applied to the first toroidal transformer, a corresponding electrical current is induced in the first electrical circuit, wherein the induced current induces the data signal on the second toroidal transformer; and a receiver coupled to the second toroidal transformer, wherein the receiver is configured to receive the data signal induced on the second toroidal transformer.

2. The system of claim 1, wherein the first structural member comprises a conductive casing installed in the well, and wherein the second structural member comprises a conductive tubular installed in the well within the casing.

3. The system of claim 1, wherein the first structural member comprises a conductive casing installed in the well, and wherein the second structural member comprises a conductive rod coupled between a drive system and a pump installed in the well.

4. The system of claim 1, wherein the first structural member comprises a conductive tubular installed in the well, and wherein the second structural member comprises a conductive rod coupled between a drive system and a pump installed in the well.

5. The system of claim 1, further comprising an annular space between the first structural member and the second structural member.

6. The system of claim 1, wherein the first portion of the annular space is no more than 60 feet in length and wherein the second portion of the annular space is at least 100 feet in length.

7. The system of claim 1, further comprising;

a third toroidal transformer positioned around the second structural member at a fifth axial location which is between the third axial location and the fourth axial location; and a transceiver coupled to the third toroidal transformer, wherein the transmitter is configured to communicate with at least one of the transmitter and the receiver via data the third transformer and the first electrical circuit.

8. The system of claim 1, wherein a first transceiver that includes the transmitter is coupled to the first toroidal transformer, wherein a second transceiver that includes the receiver is coupled to the second toroidal transformer, and wherein the first and second transceivers are configured to communicate bidirectionally through the first circuit.

9. A method implemented in a well having first and second structural members of a well completion system, wherein the first and second structural members are coaxially positioned with an annular space between the first structural member and the second structural member, a first portion of the annular space being filled with a well fluid and a second portion of the annular space being filled with air, wherein the first and second structural members are electrically coupled to form a first electrical circuit, the well completion system including first and second toroidal transformers positioned at axially different locations around one of the structural members with a transmitter coupled to the first toroidal transformer and a receiver coupled to the second toroidal transformer, the method comprising:

generating, at the transmitter, a first voltage embodying a data signal;

applying the first voltage to the first toroidal transformer, wherein the first toroidal transformer induces a current corresponding to the data signal in the one of the structural members around which the first toroidal transformer is positioned;

inducing in the second toroidal transformer, by the current in the one of the structural members around which the first toroidal transformer is positioned, a second voltage embodying the data signal;

providing the second voltage to the receiver; and extracting, by the receiver, the data signal from the second voltage.

10. The method of claim 9, further comprising making one or more measurements using equipment positioned downhole in a well, generating the data signal in dependence on the one or more measurements, and providing the data signal to the transmitter.

11. The method of claim 10, further comprising storing data corresponding to the one or more measurements in a data store coupled to the downhole equipment.

12. The method of claim 9, wherein making the one or more measurements comprises measuring one or more operating conditions at a location of an electric submersible pump (ESP) installed in the well.

13. The method of claim 9, wherein the one of the structural members in which the current is induced comprises a tubular through which fluid is pumped out of the well.

14. The method of claim 9, wherein the one of the structural members in which the current is induced comprises a pump rod coupled between a pump installed downhole in the well and a drive system installed at the surface of the well, where the drive system drives the pump rod and wherein the pump rod drives the pump to pump fluid out of the well.

15. The method of claim 9, further comprising positioning a third toroidal transformer around the one of the structural members between the first and second toroidal transformers with a second receiver coupled to the third toroidal transformer, the method further comprising:

inducing in the third toroidal transformer, by the current in the one of the structural members around which the first toroidal transformer is positioned, a third voltage embodying the data signal;

providing the second voltage to the second receiver; and extracting, by the second receiver, the data signal from the third voltage.

16. A system comprising:

a first structural member of a well completion;

a second structural member of the well completion;

a first electrical coupling between the first structural member and the second structural member at a first axial location;

a second electrical coupling between the first structural member and the second structural member at a second axial location, wherein the first structural member, the second structural member, the first electrical coupling and the second electrical coupling form a first electrical circuit;

a first toroidal transformer positioned around the second structural member at a third axial location which is between the first axial location and the second axial location;

a second toroidal transformer positioned around the second structural member at a fourth axial location which is between the first axial location and the second axial location;

a transmitter coupled to the first toroidal transformer, wherein the transmitter is configured to generate a data signal at a frequency of between 30 Hz and 300 Hz, wherein when the data signal is applied to the first toroidal transformer, a corresponding electrical current is induced in the first electrical circuit, wherein the induced current induces the data signal on the second toroidal transformer; and a receiver coupled to the second toroidal transformer, wherein the receiver is configured to receive the data signal induced on the second toroidal transformer.

* * * * *